US007401754B2

(12) United States Patent
Welch et al.

(10) Patent No.: US 7,401,754 B2
(45) Date of Patent: Jul. 22, 2008

(54) SHELF SUPPORT SYSTEM HAVING A CYLINDRICAL SUPPORT POST AND PROVIDING IMPROVED STABILITY AND RIGIDITY

(75) Inventors: Robert J. Welch, Dallas, PA (US); David A. Reppert, Kingston, PA (US); John H. Welsch, Moscow, PA (US)

(73) Assignee: Metro Industries, Inc., Reno, NV (US)

( * ) Notice: Subject to any disclaimer, the term of this patent is extended or adjusted under 35 U.S.C. 154(b) by 39 days.

(21) Appl. No.: 11/222,832

(22) Filed: Sep. 12, 2005

(65) Prior Publication Data

US 2007/0057131 A1 Mar. 15, 2007

(51) Int. Cl.
*A47B 96/06* (2006.01)

(52) U.S. Cl. ..... 248/218.4; 248/235; 108/110; 108/192; 211/187

(58) Field of Classification Search ..... 248/218.4, 248/222.13, 222.51, 227.3, 230.2, 231.31, 248/410, 412, 411, 245; 108/110, 147.13; 211/187

See application file for complete search history.

(56) References Cited

U.S. PATENT DOCUMENTS 3,424,111 A * 1/1969 Maslow ..... 108/147.13
3,523,508 A * 8/1970 Maslow ..... 108/147.13
4,811,670 A * 3/1989 Kolvites et al. ..... 108/107
4,964,350 A * 10/1990 Kolvites et al. ..... 108/110
5,271,337 A * 12/1993 Kolvites et al. ..... 108/107
5,279,231 A * 1/1994 Kolvites et al. ..... 108/107
6,017,009 A * 1/2000 Swartz et al. ..... 248/245
6,113,042 A * 9/2000 Welsch et al. ..... 248/218.4
7,086,633 B2 * 8/2006 Welch et al. ..... 248/218.4

* cited by examiner

*Primary Examiner*—Anita M King
(74) *Attorney, Agent, or Firm*—Fitzpatrick, Cella, Harper & Scinto

(57) ABSTRACT

A shelf support system includes a sleeve or wedge member and a collar adapted to be secured to a generally cylindrical support post, that is one that is circular when viewed in radial cross-section. The sleeve has an inner surface that is configured to embrace the support post and an outer surface formed with a first axially outwardly inclined wedge portion and at least one second axially outwardly inclined wedge portion that, when viewed in such radial cross-section, extends at an angle to the first portion. Additionally, the collar is adapted to be secured to a member to be supported and to embrace the sleeve. The collar has a first wedge surface formed to mate with the first portion of the outer surface of the sleeve and at least one second wedge surface formed to mate with the second portion of the outer surface of the sleeve. Thus, when the sleeve embraces the post and the collar embraces the sleeve, axial loading of the collar in one direction causes the first wedge surface to mate with the first portion of the outer surface of the sleeve and the second wedge surface to mate with the second portion of the outer surface of the sleeve, thereby urging the sleeve toward the post in at least two generally radial directions.

16 Claims, 5 Drawing Sheets

SHELF SUPPORT SYSTEM HAVING A CYLINDRICAL SUPPORT POST AND PROVIDING IMPROVED STABILITY AND RIGIDITY

BACKGROUND OF THE INVENTION

I. Field of the Invention

The present invention relates generally to a support structure that can be used to support shelving or other elements for carrying or supporting any desired item. More particularly, the present invention relates to a support assembly for use in, for example, a knock-down shelving system to adjustably support shelves.

The support assembly of the present invention ideally can be incorporated into a knock-down shelving system that includes a plurality of support posts for supporting one or more shelves at corner support assemblies thereof. The shelving system will include a sleeve or wedge member and a collar adapted to be secured to a generally cylindrical support post, that is one that is circular when viewed in radial cross-section. The sleeve has an inner surface that is configured to embrace the support post and an outer surface formed with a first axially outwardly inclined wedge portion and at least one second axially outwardly inclined wedge portion that, when viewed in such radial cross-section, extends at an angle to the first portion. Additionally, the collar is adapted to be secured to a member to be supported and to embrace the sleeve. The collar has a first wedge surface formed to mate with the first portion of the outer surface of the sleeve and at least one second wedge surface formed to mate with the second portion of the outer surface of the sleeve. Thus, when the sleeve embraces the post and the collar embraces the sleeve, axial loading of the collar in one direction causes the first wedge surface to mate with the first portion of the outer surface of the sleeve and the second wedge surface to mate with the second portion of the outer surface of the sleeve, thereby urging the sleeve toward the post in at least two generally radial directions.

II. Description of the Prior Art

Shelving systems having adjustable height shelves and so-called "knock-down" type shelving systems are known, and each has utility in many applications. For example, a knock-down shelving system with adjustable height shelves may be used in the food service, industrial, commercial, hospital, and similar fields for storage of desired items.

One type of a well known knock-down shelving system is disclosed in U.S. Pat. Nos. 3,424,111 and 3,523,508 both to Maslow, and is manufactured and sold by InterMetro Industries Corporation, Wilkes-Barre, Pa., a company related to the assignee of the present invention. The shelving system disclosed in these patents has achieved great commercial success under the InterMetro trademark SUPER ERECTA SHELF®, and incorporates a plurality of cylindrical support posts each formed with a series of equally spaced, annular grooves on its outer surface. A basic shelving system might include four such posts to support one or more formed-wire shelves, with each shelf having a frusto-conically-shaped collar at each corner for receiving a support post. A two-piece interlocking sleeve fits around the support post. The sleeve features a rib on its interior surface for engaging one of the grooves on the support post and has a frusto-conically-shaped outer surface, which is widest at the bottom, designed to complement the shape of the shelf collars. The support posts fitted with sleeves are received in the collars of each shelf to assemble the shelving system. When assembled, the weight of the shelf and any items stored on it creates a radially-inwardly directed wedging force between the collars and sleeves, which brings the sleeves into tight contact with the posts.

Another type of commercially successful shelving system, sold and marketed under the trademark METROMAX® by InterMetro Industries, features a "knock-down" structure that incorporates triangular support posts. Such a system is the subject of U.S. Pat. Nos. 4,811,670; 4,946,350; 5,271,337; and 5,279,231.

In U.S. Pat. No. 4,811,670, a corner assembly for securing each corner of a shelf to the triangular support post includes a wedge member, a corner bracket structurally associated with the shelf, and a collar. The wedge member snap-fits onto the support post, and the collar and corner bracket form a sleeve that may fit around the wedge and support post, thereby to support the shelf by a wedging force.

The shelving systems shown in U.S. Pat. Nos. 4,964,350; 5,271,337; and 5,279,231 feature modular shelves in combination with the triangular support posts. The modular shelves include a rectangular shelf frame formed from two end beams connected to two side beams. A center beam may be inserted between the end beams, parallel to the side beams, to increase the load-bearing capacity of the system. A plurality of plastic shelf mats are adapted to be snap-fit onto the shelf frame. The shelf frame is secured to the support post by corner assemblies comprised of a corner portion of the end beam, a wedge member and a separate collar. A sleeve formed by the corner portion and the collar is seated on the support post and wedge member and secured by a wedging action. Two lock cylinders lock the collar to the corner portion to secure the sleeve.

Still another type of commercially successful shelving system manufactured and sold by InterMetro Industries is disclosed in U.S. Pat. No. 6,113,042 (Welsch). In one embodiment, this system includes a two-piece wedge assembly configured to embrace a circular support post. The wedge assembly is formed of a sleeve and a wedge that are snap-fit or otherwise joined together about the support post. The wedge has a single planar wedge surface that tapers outwardly from its upper end to its lower end, such that the lower end is wider, and extends toward the interior of the shelving system. A collar, having a rear section that outwardly inclines from top to bottom to complement the slope of the single wedge surface, is seated on the wedge assembly and secured by wedging action.

(Each of the patents mentioned above is incorporated in its entirety herein by reference.)

Despite the significant utility and commercial success of the above-described shelving systems, a need exists for an even more highly stable shelving system, utilizing a cylindrical support post, that is easily assembled and has shelves that are easily adjusted to different heights without the need for special tools, and in which the shelves are secured in a static manner to provide a load carrying capacity suitable for heavy-duty use. In particular, it is desirable to provide a system in which a support member can be secured to a cylindrical support post so as to provide stability and rigidity in multiple radial directions relative to the axis of the post.

SUMMARY OF THE INVENTION

For purposes of explanation, the present invention will be described with reference to a shelving system. In its broadest aspect, however, this invention relates to a support assembly capable of use in many types of support systems. The support system can support shelves, as described in greater detail below, and other elements for carrying a wide variety of items. For example, the support system can support combinations of shelving, drawers, work surfaces, racks, bins, hooks and the like.

Accordingly, the present invention can provide a highly stable shelf support assembly for use in an easy to assemble and easy to adjust heavy-duty shelving system.

Additionally, the present invention can provide a highly stable shelf support assembly that is statically secured to the shelving system to provide substantial load bearing capacity.

In accordance with one aspect of the invention, a system is provided for supporting a member on a support post, the support post being generally cylindrical, that is, being generally circular when viewed in radial cross-section. The system comprises a sleeve having an inner surface configured to embrace the support post and an outer surface formed with a first axially outwardly inclined portion and a least one second axially outwardly inclined portion that, when viewed in such radial cross-section, extends at an angle to the first portion. A collar is adapted to be secured to the member and embrace the sleeve. The collar has a first wedge surface formed to mate with the first portion of the outer surface of the sleeve and at least one second wedge surface formed to mate with the second portion of the outer surface of the sleeve.

When the sleeve embraces the post and the collar embraces the sleeve, axial loading of the collar in one direction causes the first wedge surface to mate with the first portion of the outer surface of the sleeve and the second wedge surface to mate with the second portion of the outer surface of the sleeve, thereby urging the sleeve toward the post in at least two generally radial directions.

In another aspect of the present invention, the system for supporting a member comprises a generally cylindrical support post, a sleeve having a generally cylindrical inner surface configured to embrace the post and an outer surface formed with a first axially outwardly inclined portion and at least one second axially outwardly inclined portion that, when viewed in radial cross section, extends at an angle to the first portion. The system also comprises a collar adapted to be secured to the member and embrace the sleeve, the collar having a first wedge surface formed to mate with the first portion of the outer surface of the sleeve and at least one second wedge surface formed to mate with the second portion of the outer surface of the sleeve.

When the sleeve embraces the post and the collar embraces the sleeve, axial loading of the collar in one direction causes the first wedge surface to mate with the first portion of the outer surface of the sleeve and the second wedge surface to mate with the second portion of the outer surface of the sleeve, thereby urging the sleeve toward the post in at least two generally radial directions.

These and other objects, aspects, features and advantages of the present invention will become apparent from the following detailed description of the preferred embodiment taken in conjunction with the accompanying drawings.

DESCRIPTION OF THE PREFERRED EMBODIMENTS

For purposes of explanation only, and to illustrate in part how the present invention may be adapted easily to conventional shelving technology, the support assembly of the present invention will be described below as used in a knock-down shelving system. The shelving system generally includes a plurality of support posts which are cylindrical, that is, that are generally circular in radial cross-section. In particular, four such posts are arranged to support one or more shelves at corner assemblies thereof. Of course, the support assembly of the present invention can be used in various other types of support systems, such as cabinets, closets, and the like, with a shelving system being only one example. Moreover, the support assembly can be used in conjunction with many shelf embodiments and is not limited to use with a corner of a shelf, or for that matter, a corner of any supported member. In the examples given below, the support assembly is structurally associated with a wire shelf frame designed to be fitted with plastic shelf mats like those shown and described in U.S. Pat. Nos. 4,964,350; 5,271,337; and 5,279,231. However, the support assembly of the present invention will be readily adaptable to many other shelf or support structure embodiments including, but not limited to, a wire shelf or a solid sheet metal shelf.

Figure 1:
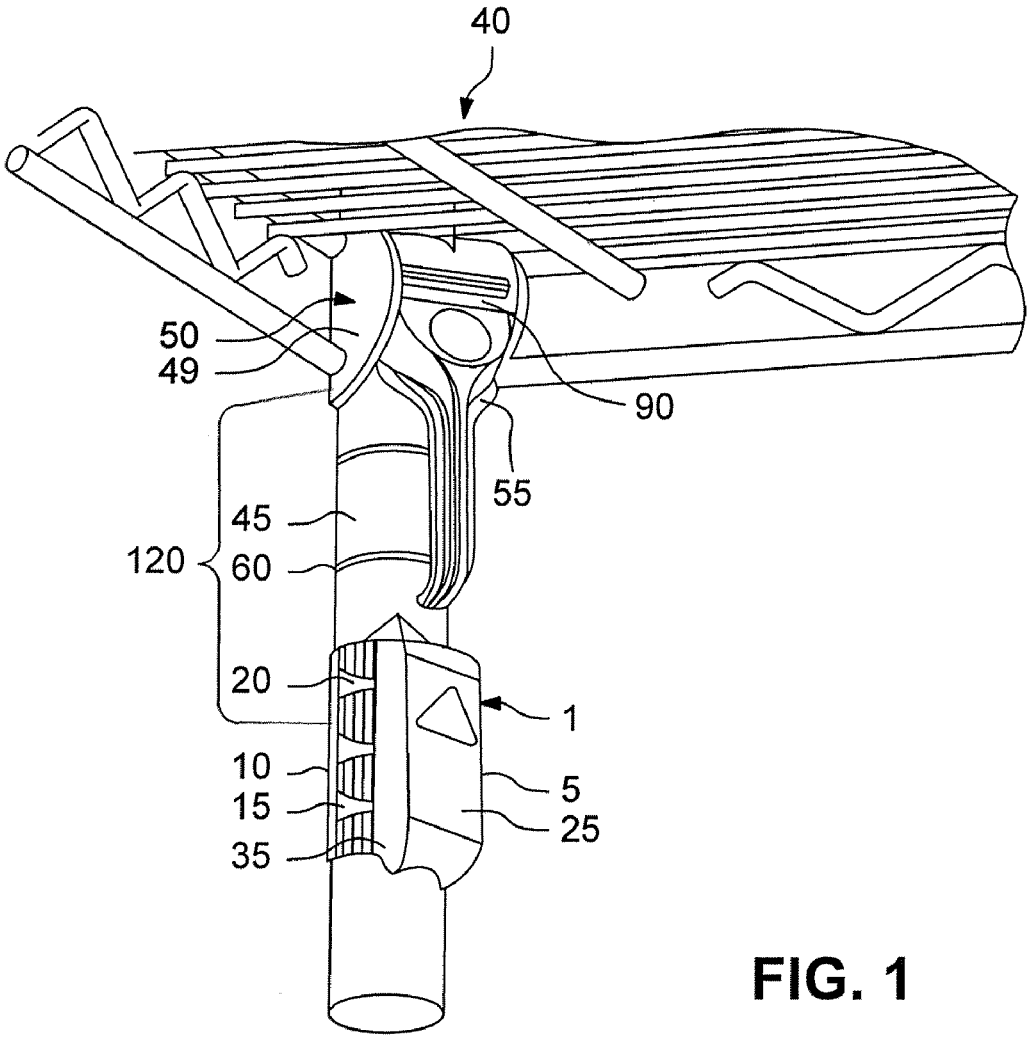
FIG. 1 is a partial perspective view of a corner of a shelving system in accordance with the present invention, viewed from below.
Figure 2:
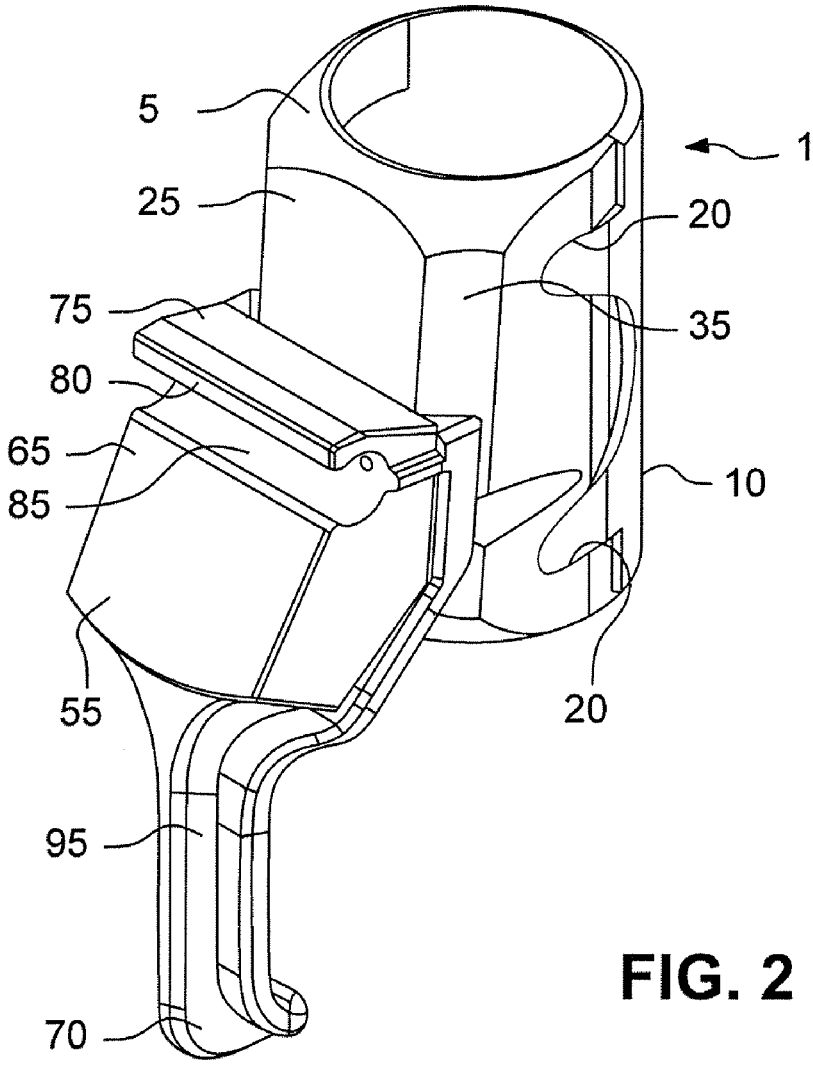
FIG. 2 is a perspective view of the sleeve and a locking mechanism, which forms a portion of the collar in accordance with a preferred embodiment of the present invention, viewed from above.
Figure 3:
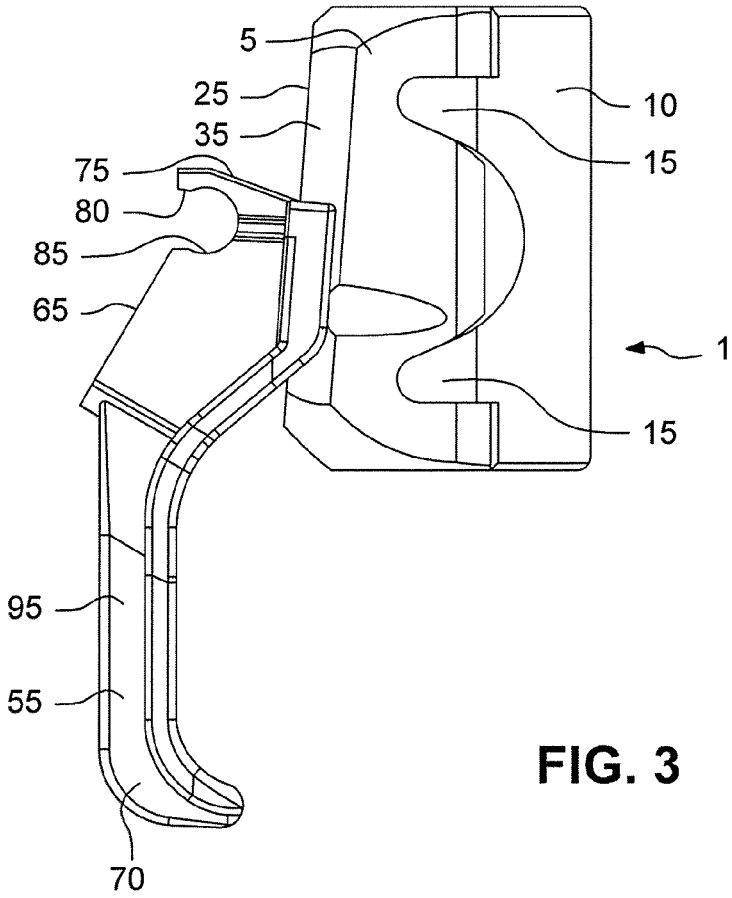
FIG. 3 is a side view of a sleeve or wedge member in accordance with the present invention mated with the locking mechanism, shown in a locked position.

FIG. 1 illustrates one corner of a shelving system utilizing the support assembly 120 in accordance with the present invention. In this figure, a wire frame 40, which may form a shelf, is positioned on an elongated generally cylindrical support post 45. The wire frame 40 is attached to a portion 49 of a collar, generally designated at 50, by, for example, welding. A locking mechanism, or flipper, 55 forms the remainder of the collar in accordance with the preferred embodiment. The locking mechanism and the structure for mounting it with the wire frame generally are of the form described in U.S. Pat. No. 6,113,042. However, the locking mechanism is modified as described below in accordance with the present invention. When the collar 50 is seated on a sleeve or wedge member 1 with the locking mechanism 55 in its locked position (as shown in FIGS. 2 and 3), the sleeve 1 is radially compressed against the support post 45. Seating the collar 50 on the sleeve 1 with the locking mechanism 55 in its locked position creates a wedging force that provides substantial load-bearing capacity as will also be described in greater detail below.

Figure 4:
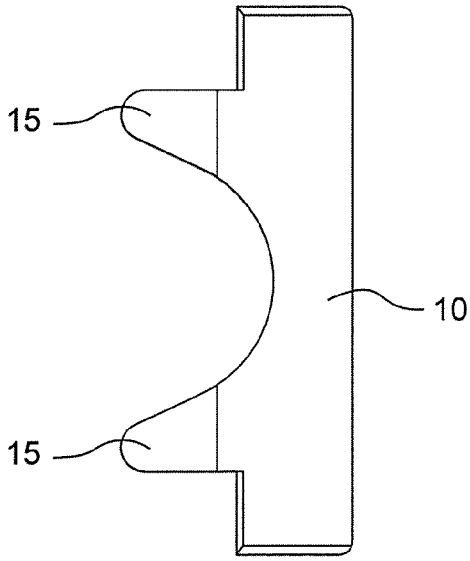
FIG. 4 is a side view of one part of the sleeve or wedge member.
Figure 5:
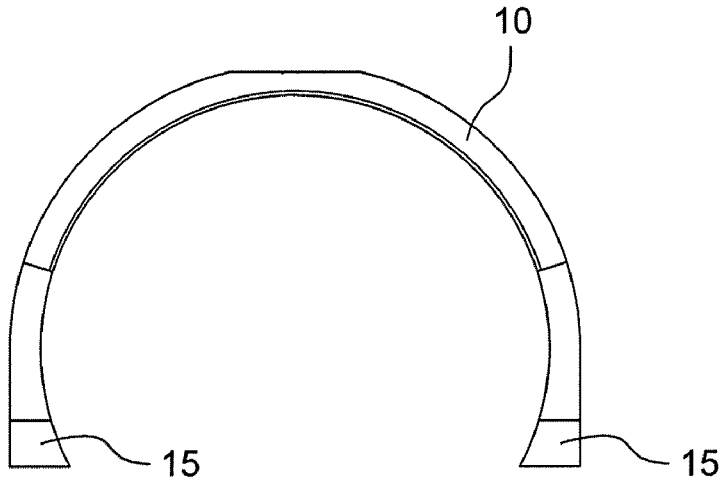
FIG. 5 is a top plan view of the part of the sleeve or wedge member shown in FIG. 4.
Figure 6:
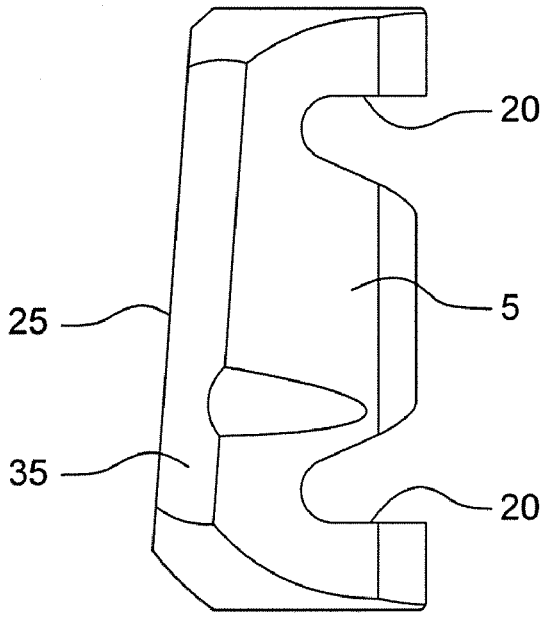
FIG. 6 is a side view of the second part of the sleeve or wedge member.
Figure 7:
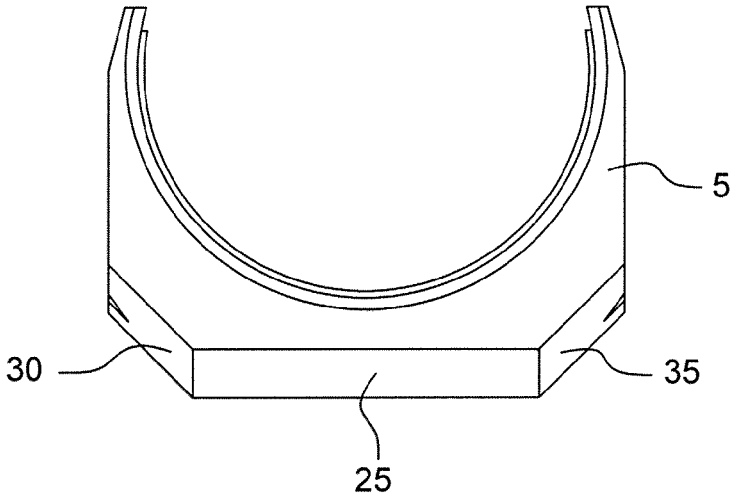
FIG. 7 is a top plan view of the second part of the sleeve or wedge member.

FIGS. 2 and 3 are respectively perspective and side views of the sleeve 1, which comprises two pieces, and of the locking mechanism 55. As seen there, a first sleeve section 5 and a second sleeve section 10 are fit together. In this embodiment, the second sleeve section 10 includes pairs of generally diametrically opposed tabs 15 (FIG. 4), each of which engages a complimentary notch 20 (FIG. 6) formed in the first sleeve section 5 to complete the sleeve assembly. As can be seen in FIGS. 5 and 7, the interfitting tab and notch configuration permits each of the first and second sleeve sections to have an inner surface that extends more than 180 degrees about the axis of each section. In that way each sleeve section can be snapped onto and be retained on the post 45. The interfitting tabs and notches then ensure that the sleeve sections are properly aligned vertically on the post. The two-piece assembly allows the sleeve to be easily detached from and moved along the support post to any one of a number of desired positions. Although not seen in the FIGS., to enhance stability and to ensure accurate placement of the sleeve 1 on the support post 45, the first sleeve section preferably has at least one internal bead or ridge, for engaging one of a number of horizontal annular grooves 60 that may be formed at regular spacing in the support post 45.

As an alternative to the tab and notch arrangement shown in FIGS. 2, 3, 4 and 6 the first and second sleeve sections can fit together by other comparable means. For example, the first sleeve section and the second sleeve section may be hinged together. Of course, other methods of connecting the first sleeve portion and the second sleeve portion can be used.

FIGS. 2, 3, 6 and 7 illustrate the outer surface of the first sleeve section 5 in accordance with the present invention. As can be seen there, the outer surface has three axially outwardly inclined portions 25, 30 and 35. First axially outwardly inclined portion 25 is flanked on opposite sides by a second axially outwardly inclined portion 30 and a third axially inclined portion 35. The three axially outwardly inclined portions are planar faces that taper outwardly from the upper end to the lower end of the sleeve section. A view of how the second axially inclined portions taper can be seen in FIGS. 2 and 7. In the preferred embodiment, the taper is shallow to maximize rigidity and minimize thickness of the sleeve. For example, the taper can be on the order of 4 degrees.

Also, as seen in FIG. 7, the second and third axially outwardly inclined portions extend at an angle to the first axially outwardly inclined portion 25 when viewed in radial cross-section. This configuration is advantageous because when the locking mechanism 55 is in its locked position as described further below, its complimentary design compresses the sleeve 1 against the support post 45 in multiple generally radial directions. In the case of the present embodiment, the sleeve 1 has three axially outwardly inclined portions resulting in a compression of the sleeve 1 against the support post 45 in three generally radial directions. The fact that there are multiple axially outwardly inclined portions allowing for compression in multiple radial directions against the support post 45 helps to provide a support system having superior stability and rigidity in the side-to-side and front-to-back directions of the system.

It should be noted that although the sleeve depicted in this embodiment has three axially outwardly inclined portions, the sleeve is not limited to this number. Indeed, the sleeve of the present invention can have any number of axially outwardly inclined portions, so long as the sleeve has at least two such portions.

As seen in FIG. 1, the sleeve 1 is configured to embrace the support post 45, which has a generally circular radial cross-section. Accordingly, as seen in FIGS. 5 and 7, the first sleeve section and the second sleeve section each have an interior surface that is configured to engage the support post and thus have a generally circular radial cross-section. Therefore, when the first sleeve section 5 and second sleeve section 10 are mated together, the sleeve 1 has an interior surface that is complementary to the generally cylindrical outer surface of the support post 45.

Figure 8:
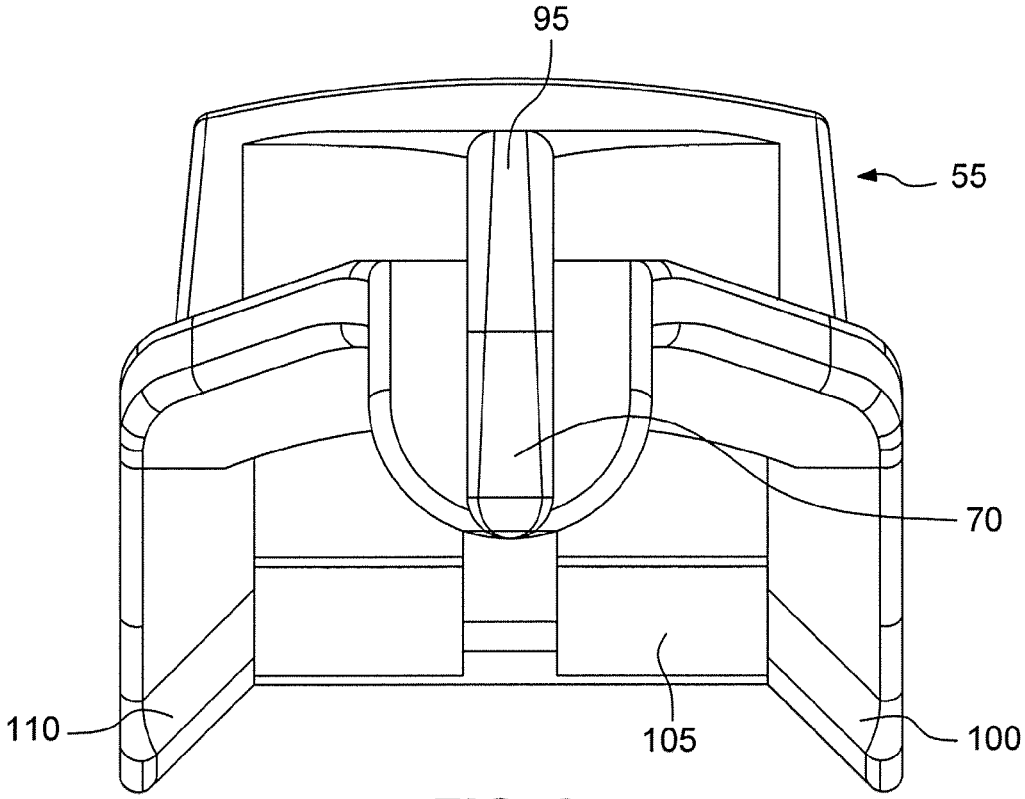
FIG. 8 is a bottom plan view of the locking mechanism.

FIGS. 2, 3 and 8 provide views of the locking mechanism, or flipper, 55 of the present invention. The locking mechanism, which is preferably integrally formed, has an upper end 65 and a lower end 70. Further, the top end has a first portion 75, and a second portion 80 defining part of an open cylindrical cavity 85 for receiving a shaft 90 (shown in FIG. 1) of the collar 50, as described in U.S. Pat. No. 6,113,042. The lower end preferably includes a handle 95 that may be grasped by the user. A rear face of the locking mechanism 55 is shaped to complement the shape of the axially outwardly inclined portions of the sleeve 1. The locking mechanism is mounted on the collar to rotate about the longitudinal axis of the shaft 90. The preferred material for the flipper is a rigid plastic such as, for example, reinforced nylon.

While in this embodiment the cylindrical cavity 85 and shaft 90 interface to rotatably support the flipper on the collar, other means for rotatably supporting the flipper could be provided without departing from the scope of the invention. For example, the flipper could have rounded beads on either end that would sit in complementary shaped indents on the collar, or conversely, the collar could have the rounded beads which mate with indents on opposite ends of the flipper.

Additionally, although the lower end of the locking mechanism in this embodiment has a handle, other designs can be used without departing from the scope of the present invention. For example, the lower end 70 may instead include a flat manipulating portion for grasping by the user.

The rear surface of the locking mechanism will now be described in greater detail with reference to FIG. 8. This figure shows how the rear surface of the locking mechanism complements the shape of the sleeve. More specifically, the rear surface includes three wedge surfaces 100, 105 and 110. The wedge surfaces 100, 105 and 110 are formed to be substantially congruent in horizontal cross section to the axially outwardly inclined portions 35, 25 and 30 of the sleeve 1, respectively, and thereby to mate with those portions. As discussed above, when the collar embraces the sleeve and the locking mechanism is in its locked position, the mating of wedge surfaces 100, 105 and 110 with axially outwardly inclined portions 35, 25 and 30, respectively, compresses the sleeve and urges the sleeve toward the support post in three generally radial directions. It will be understood by those skilled in the art that by combining to exert compressive force on the collar through the sleeve onto the cylindrical post in three different radial directions a substantial improvement in overall stability of the system in such multiple directions is achieved. Therefore, this system may be used in applications requiring higher load bearing capabilities. In addition, when the locking mechanism is lowered down onto a sleeve, which is mounted on a support post, engagement of the wedge surfaces with the inclined portions will tend to correct misalignment of the locking mechanism and sleeve by causing the sleeve to rotate about the post into proper alignment. Once proper alignment is achieved and the respective wedges surfaces are tightly engaged, the stability and rigidity of the assembly are enhanced.

It should be noted that although the collar and locking mechanism of this embodiment are separate structures, the present invention is not limited thereto. In fact, although preferred, a locking mechanism is not necessary for the present invention. When no locking mechanism is present, for example, the collar 50 may be a single member adapted to embrace the sleeve 1. The collar would then have the wedge surfaces that mate with the axially outwardly inclined portions of the sleeve 1, when the collar is seated on the sleeve. Additionally, like the sleeve, the collar may be a two-piece structure and the sections of the collar designed to mate with each other via, for example, a tab and notch arrangement or the sections may be hinged together.

Returning to FIG. 1, the support post 45 includes a plurality of annular grooves 60 that are, as noted, preferably, but not necessarily, evenly spaced in the axial direction of the post. The grooves receive the internal beads of the sleeve. As will be appreciated, other comparable detent means for positioning the sleeve on the support post, such as detent tabs and detent steps as disclosed in U.S. Pat. No. 4,811,670, could be used without departing from the scope of the present invention.

Also, although not shown in the drawings, the top end of each support post 45 can be fitted with an end cap and the bottom end with a caster, a vertically-adjustable foot, an end cap, or the like. As one example, the bottom end of the support post can be fitted with a threaded stem receptacle for receiving a threaded leveling leg.

An additional feature of this embodiment of the present invention relates to the ability of the locking mechanism to easily and quickly release the wedging action between the collar and the sleeve. This capability frees the shelf to move up or down relative to the support posts. To release the wedging action, the locked flipper is rotated upwardly in a vertical direction. By rotating the flipper in this manner, the compression force between the locking mechanism and the sleeve is relieved. Actuation of the flipper by the user thus allows for quick and reliable releasing of the wedging action so that the system may be repositioned on the post.

Another feature of this embodiment of the present invention is directed to the ability of the flipper to allow the corner assembly to slide over the support post and mounted sleeve. At rest and when not engaged on a sleeve, the flipper normally hangs, by gravity, in the locked position. When the flipper is in this position and the corner shelf assembly is positioned below a sleeve mounted on the support post, and the shelf is thereafter raised, the lower (and wider) end of the sleeve will initially contact the first portion 75 of the upper end of the flipper. Because the distance between a shaft 90, received in the second portion 80, and the first portion 75 is less than the distance between the shaft and the wedge surfaces 100, 105, and 110 (FIG. 3), the flipper will rotate further toward the unlocked (or open) position. As the flipper is biased toward its locked position, the contour of the upper end allows the flipper to pass completely over the sleeve.

The ability of the flipper to be rotated automatically by the sleeve allows the support assembly 120 to be raised easily up the support post. As will be appreciated, when the support assembly is raised over a series of sleeves spaced apart on the support post, the flipper will rotate automatically as described above as it passes over each sleeve and, as it clears the sleeve, rotate in the opposite direction back to its at-rest position. However, this action of the flipper takes place only in one direction, i.e., raising of the support assembly 120 relative to the support post, and in that sense can be described as a ratchet-like movement. When the support post slides along the support post in the opposite direction, i.e., downward toward a mounted sleeve, the rear face of the flipper mounts with the axially outwardly inclining portions of the sleeve and creates a wedging action. Of course, if the flipper is held in its raised, or unlocked position, the flipper will clear the sleeve and the support assembly can slide downward over the support post and mounted sleeve.

The ability of the corner support assembly to translate relative to the sleeve mounted on the support post and slide completely thereover enables both the assembly of a shelving system and an adjustment of the height of the shelves to be accomplished with ease. To adjust the height of an individual shelf, for example, a second set of sleeves can be secured to the support posts at the desired new height. The flippers at the corner support assemblies are then rotated to the unlocked positions, releasing the compression force applied to the sleeves by the flippers and allowing the self to be raised or lowered. To raise the height of the shelf, the shelf is raised along the support posts to allow the flippers to pass over the second set of sleeves in the manner described above. Once the flippers clear the sleeves (such that each flipper can rotate back to its at-rest position), the shelf can be lowered, whereby the flippers will seat on their respective sleeve to create the desired wedging force. The first set of sleeves can then be removed from the support posts, if desired.

It will be appreciated that with this arrangement, the flippers "self-regulate" as they return to the at-rest position to match the slope of the sleeve. The flippers thus automatically come to rest against a respective sleeve, regardless of the slope of the sleeve, to create the necessary wedging force.

To assemble a shelving system with a plurality of shelves using the corner support assembly of the present invention, the shelves can be stacked on the floor one on top of another. One set of sleeves for each shelf is positioned on the support posts at the desired shelf heights, and then the support posts are inserted in the aligned corner support assemblies of the shelves. Each shelf can then be raised, one-by-one, over the sets of sleeves provided for lower shelves and then over its designated set of sleeves positioned at the desired height. As each shelf passes over the designated sleeves, it is lowered back thereon to allow the flippers, which fall back to the at-rest position once the sleeves are cleared, to engage and seat against the sleeves to create a wedging force for supporting the shelf. This "bottom up" assembly allows the shelving system to be put together quickly and easily.

This static system of supporting shelves, i.e., securing the shelves to the support posts, allows for significant stability and load-bearing capacity while providing an easy to assemble and easy to adjust support system. Moreover, by providing a specifically designed sleeve and cooperating collar and locking mechanism assembly for use with a cylindrical support post, enhanced stability and rigidity in multiple radial directions are achieved.

Although specific embodiments of the present invention have been described above in detail, it will be understood that this description is merely for purposes of illustration. Various modifications of and equivalent structures corresponding to the disclosed aspects of the preferred embodiments in addition to those described above may be made by those skilled in the art without departing from the spirit of the present invention which is defined in the following claims, the scope of which is to be accorded the broadest interpretation so as to encompass such modifications and equivalent structures.

What is claimed is:

1. A system for supporting a member on a support post, the support post being generally circular when viewed in radial cross-section, said system comprising:

a sleeve having an inner surface generally circular in cross-section to embrace the support post and an outer surface formed with a first axially outwardly inclined portion and at least one second axially outwardly inclined portion that, when viewed in radial cross-section, extends at an angle to said first inclined portion; and a collar adapted to be secured to the member and embrace said sleeve, said collar having a first wedge surface formed to mate with said first inclined portion of said outer surface of said sleeve and at least one second wedge surface formed to mate with said second inclined portion of said outer surface of said sleeve;

wherein, when said sleeve embraces the post and said collar embraces said sleeve, axial loading of said collar in one direction causes said first wedge surface to mate with said first inclined portion of the outer surface of said sleeve and said second wedge surface to mate with said second inclined portion of the outer surface of the sleeve, thereby to urge said sleeve toward the post in at least two generally radial directions, and wherein said sleeve comprises two sections each for engaging a circumferential portion of the post, said sections of said sleeve including means for aligning said sections together to embrace the post.

2. The system according to claim 1, wherein said outer surface of said sleeve is formed with two second axially outwardly inclined surfaces, each of which when viewed in radial cross section extends at an angle to said first inclined portion of said outer surface of said sleeve, and wherein said collar has two second wedge surfaces each formed to mate with one said second inclined portion of said outer surface of said sleeve, wherein, when said sleeve embraces the post and said collar embraces said sleeve, axial loading of said collar in one direction causes said first wedge surface to mate with said first inclined portion of said outer surface of said sleeve and each said second wedge surface to mate with one said second inclined portion said outer surface of said sleeve, thereby to urge said sleeve toward the post in three generally radial directions.

3. The system according to claim 1, wherein said first and at least one said second inclined portion of said sleeve are formed on one said section of said sleeve.

4. The system according to claim 1, wherein said means for aligning said sections of said sleeve together include a tab formed on one said section and a notch formed on the other said section to receive said tab.

5. The system according to claim 1, further including means for attaching said collar to the member.

6. The system according to claim 5, wherein said attaching means comprises means for mounting said collar integrally with said member.

7. The system according to claim 6, wherein said mounting means comprises a weld of said collar to said member.

8. The system according to claim 1, wherein said collar includes means for releasably permitting said collar to embrace said sleeve.

9. A system for supporting a member, comprising:

a generally cylindrical support post;

a sleeve having a generally cylindrical inner surface configured to embrace said post and an outer surface formed with a first axially outwardly inclined portion and at least one second axially outwardly inclined portion that, when viewed in radial cross section, extends at an angle to said first inclined portion; and a collar adapted to be secured to the member and embrace said sleeve, said collar having a first wedge surface formed to mate with said first inclined portion of said outer surface of said sleeve and at least one second wedge surface formed to mate with said second inclined portion of said outer surface of said sleeve;

wherein, when said sleeve embraces said post and said collar embraces said sleeve, axial loading of said collar in one direction causes said first wedge surface to mate with said first inclined portion of the outer surface of said sleeve and said second wedge surface to mate with said second inclined portion of said outer surface of said sleeve, thereby to urge said sleeve toward said post in at least two generally radial directions, wherein said sleeve comprises two sections each for engaging a circumferential portion of said post, said sections of said sleeve including means for aligning said sections together to embrace said post.

10. The system according to claim 9, wherein said outer surface of said sleeve is formed with two second axially outwardly inclined surfaces, each of which when viewed in radial cross section extends at an angle to said first inclined portion of said outer surface of said sleeve, and wherein said collar has two second wedge surfaces each formed to mate with one said second inclined portion of said outer surface of said sleeve, wherein, when said sleeve embraces the post and said collar embraces said sleeve, axial loading of said collar in one direction causes said first wedge surface to mate with said first inclined portion of said outer surface of said sleeve and each said second wedge surface to mate with one said second inclined portion said outer surface of said sleeve, thereby to urge said sleeve toward the post in three generally radial directions.

11. The system according to claim 9, wherein said first and at least one said second inclined portion of said sleeve are formed on one said section of said sleeve.

12. The system according to claim 9, wherein said means for aligning said sections of said sleeve together include a tab formed on one said section and a notch formed on the other said section to receive said tab.

13. The system according to claim 9, further including means for attaching said collar to the member.

14. The system according to claim 13, wherein said attaching means comprises means for mounting said collar integrally with said member.

15. The system according to claim 14, wherein said mounting means comprises a weld of said collar to said member.

16. The system according to claim 9, wherein said collar includes means for releasably permitting said collar to embrace said sleeve.

* * * * *

UNITED STATES PATENT AND TRADEMARK OFFICE

CERTIFICATE OF CORRECTION

PATENT NO. : 7,401,754 B2
APPLICATION NO. : 11/222832
DATED : July 22, 2008
INVENTOR(S) : Robert J. Welch et al.

It is certified that error appears in the above-identified patent and that said Letters Patent is hereby corrected as shown below:

COLUMN 6:

Line 44, "load bearing" should read --load-bearing--.

COLUMN 8:

Line 1, "self" should read --shelf--.

COLUMN 9:

Line 22, "portion" should read --portion of--.

Signed and Sealed this

Twenty-eighth Day of October, 2008

JON W. DUDAS
*Director of the United States Patent and Trademark Office*